US005762427A

United States Patent [19]

Gilham

[11] Patent Number: 5,762,427

[45] Date of Patent: Jun. 9, 1998

[54] FRANKING MACHINE

[75] Inventor: Dennis Thomas Gilham, Brentwood, United Kingdom

[73] Assignee: Neopost Limited, Essex, United Kingdom

[21] Appl. No.: 590,363

[22] Filed: Jan. 25, 1996

[30] Foreign Application Priority Data

Jan. 31, 1995 [GB] United Kingdom ..... 9501851

[51] Int. Cl.[6] ..... B41J 5/00

[52] U.S. Cl. ..... 400/62; 400/63; 400/70; 395/115

[58] Field of Search ..... 400/120.01, 120.05, 400/61, 62, 63, 65, 70, 76; 395/115, 116, 117

[56] References Cited

U.S. PATENT DOCUMENTS 4,746,234 5/1988 Harry ..... 400/661.3

4,917,010 4/1990 Gilham et al. ..... 400/82

5,209,587 5/1993 Herbert et al. ..... 400/208

5,509,109 4/1996 Kim et al. ..... 395/224

*Primary Examiner*—John S. Hilten

*Attorney, Agent, or Firm*—Shoemaker and Mattare Ltd.

[57] ABSTRACT

A franking machine stores first data relating to a first impression second data relating to a second impression. Printing of both impressions or omission of the first impression and printing of only the second impression may be selected by a user. When both impressions are to be printed, the printing means is controlled to print the first impression in a first location on a mail item and to print the second impression in a second location on the mail item adjacent said first location. When omission of printing the first impression is selected the printing means is controlled to print the second impression in the first location.

9 Claims, 2 Drawing Sheets

FRANKING MACHINE

BACKGROUND OF THE INVENTION

This invention relates to franking machines and in particular to franking machines capable of printing a slogan or other information in addition to printing a franking impression Known franking machines include accounting and control means usually comprising a microprocessor operable to carry out accounting in respect of values of postage charges to be printed on mail item and to decrement a stored value of credit by an amount equal to the value of the postage charge. The microprocessor controls operation of feed means to feed the mail item past a print head and at the same time controls the print head to print a franking impression on the mail item, the franking impression including an indication of the value of the postage charge in respect of that mail item. Previously the print head has been implemented as a rotatable print drum carrying print dies and print wheels, the print dies being utilised to print an invariable part of the franking impression, and a slogan if desired, and the print wheels being settable to print variable parts of the impression comprising the value of postage charge and date. More recently it has been proposed to use a thermal print head to print the franking impression and slogan. The thermal print head includes a plurality of thermal printing elements disposed in a line extending transversely to the direction of feed of the mail item. A thermal transfer ink ribbon is interposed between the thermal printing elements and the mail item with an ink layer of the ribbon in contact with the mail item. As the mail item is fed by the feeding means past the line of thermal printing elements, with the ink layer of the ribbon in contact with and adhering to the mail item, the thermal printing elements are selectively energised by the control means in each of a plurality of printing cycles so as, in each printing cycle, to heat areas of the ink layer to cause transfer of ink from those areas to the mail item to form dots printed at selected positions on the mail item. Repeated selection and energisation of selected thermal printing elements in a series of printing cycles causes printing of dots to form a required printed impression in a line by line manner on the mail item.

SUMMARIES OF THE INVENTION

According to a first aspect of the invention a franking machine includes printing means; electronic control means; first memory means to store first data relating to a first impression; second memory means to store second data relating to a second impression; selection means operable to select printing of the first impression or omission of printing of said first impression; and said control means being operative in response to selection of printing said first impression to control the printing means to print the first impression in a first location on a mail item and to print the second impression in a second location on the mail item adjacent said first location and said control means being operative in response to selection of omission of printing the first impression to control the printing means to print the second impression in said first location.

According to a second aspect of the invention a method of using a franking machine to print a series of impressions in a series of locations associated respectively with the impressions on a mail item wherein at least one impression of the series may be selected to be printed or may be selected to be omitted includes the step, in response to selection of omission of printing said one impression, of printing the next impression of the series in the location associated with said one impression.

BRIEF DESCRIPTION OF THE DRAWING

An embodiment of the invention will be described hereinafter by way of example with reference to the drawings in which.

DESCRIPTION OF THE PREFERRED EMBODIMENT

Figure 1:
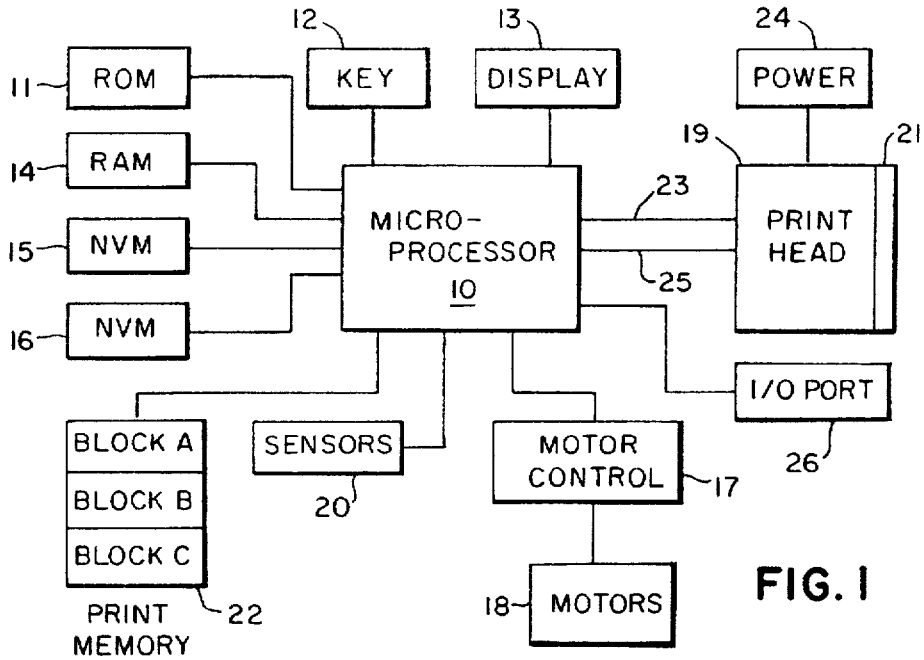
FIG. 1 is a block circuit diagram of a franking machine.

Referring first to FIG. 1, the franking machine includes electronic accounting and control means comprising a micro-processor 10 operating under program routines stored in a read only memory (ROM) 11. A keyboard 12 is provided for input of data by a user and a display 13 is provided to enable display of information to the user. A random access memory (RAM) 14 is provided for use as a working store for storage of temporary data during operation of the franking machine. Non-volatile duplicated memories 15, 16 are provided for the storage of data which is required to be retained even when the franking machine is not powered. The microprocessor 10 carries out accounting functions in relation to use of the franking machine for franking mail items with postage charges applicable to the mail items. Accounting data relating to use of the franking machine for printing franking impressions representing postage charges for mail items and any other critical data to be retained is stored in the non-volatile memories 15, 16. A motor controller 17 is controlled by the microprocessor 10 to control operation of motors 18 driving feeding means (not shown) for feeding a mail item past a digital print head 19. The digital print head 19 is preferably a thermal print head including selectively energisable thermal printing elements 21. Sensors 20 are provided to sense and monitor feeding of the mail item. The sensors provide signals to the microprocessor to enable the microprocessor to control feeding of the mail item and to selectively energise thermal print elements 21 of the print head at appropriate times as the mail item is fed past the print head. As the mail item is fed past the thermal printing elements 21 of the print head 19, during a printing operation the microprocessor reads print data stored in a memory 22 and outputs, on line 23, to the print head 19 in each of a plurality of printing cycles signals selecting those ones of the printing elements 21 which are to be energised in the respective cycle. A pulse of electrical power is supplied to the selected thermal printing elements from a power source 24 when a strobe signal is supplied by the microprocessor on line 25 to the print head.

The thermal printing elements 21 are disposed in a line extending transversely to the direction in which the mail item is fed. Energisation of selected thermal printing elements of the print head in a printing cycle causes heating of areas of the ink layer of the thermal transfer ink ribbon adjacent the energised printing elements. Heating of areas of the ink layer causes those heated areas to adhere more strongly to the mail item than the unheated parts of the ink layer so that when the ribbon is peeled from the mail item after passing the print head, the heated areas remain adhered to the mail item to form printed dots in required locations in a row. Since the mail item and thermal transfer ink ribbon are fed past the print head during the printing operation, repeated selection and energisation of selected printing elements in a series of printing cycles results in printing of dots in required positions of a series of rows spaced along the mail item in the direction of feeding of the item. Accordingly a complete printed impression is built up in a row by row manner in the series of printing cycles of a printing operation. An input/output port 26 is provided to enable communication between an external device, such as a data source, and the microprocessor 10.

Figure 2:
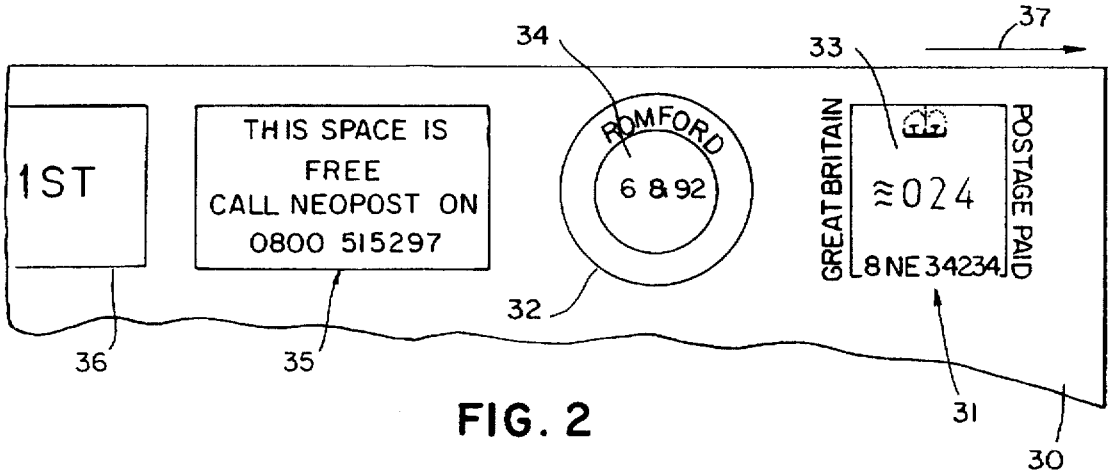
FIG. 2 illustrates an imprint on a mail item including a franking, a primary message and a secondary message.
Figure 4:
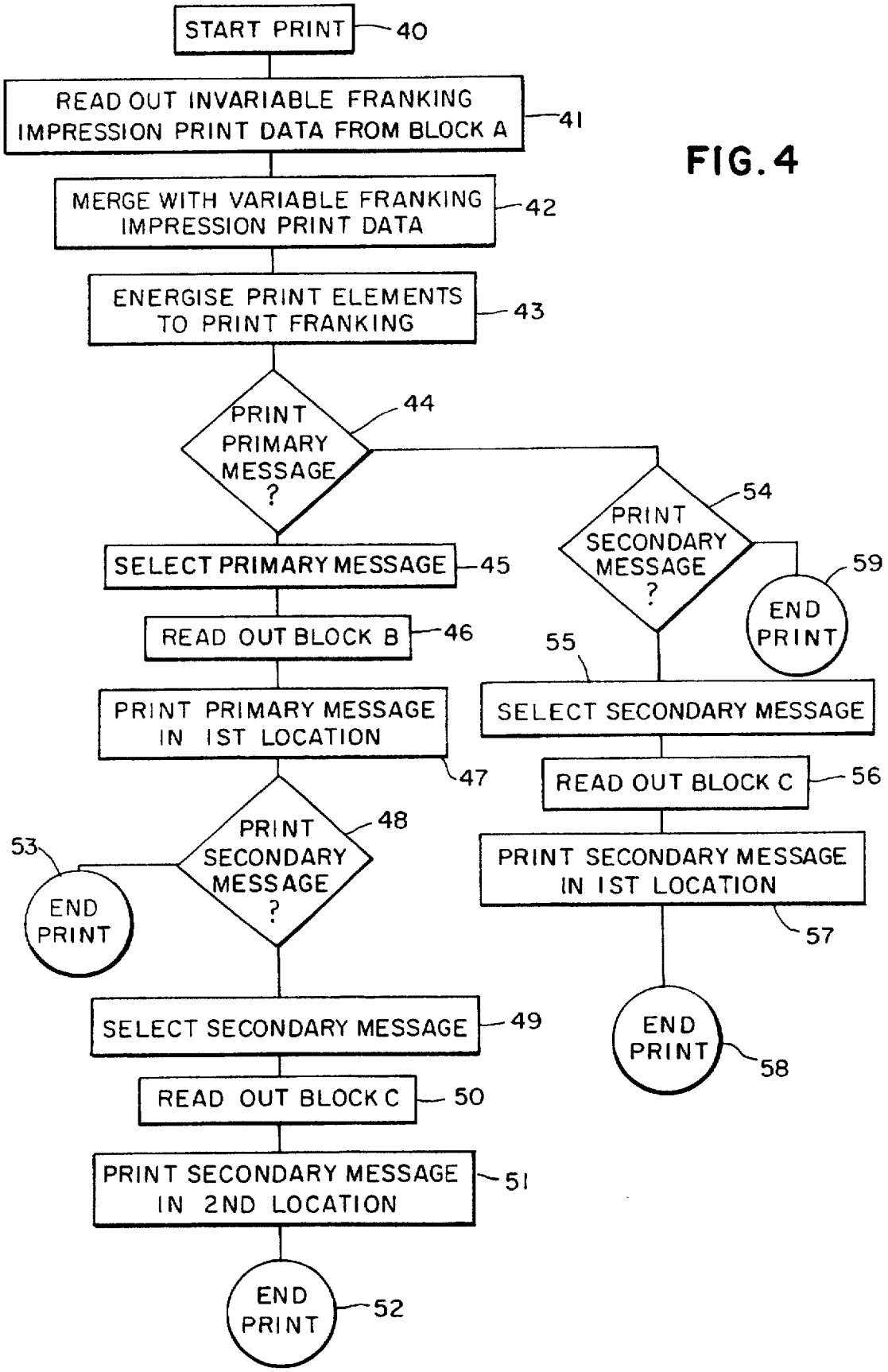
FIG. 4 is a flow chart illustrating steps in selection of messages to be included in the imprint.

Referring to FIG. 2, a franking impression printed on the mail item 30 by the franking machine comprises a fixed invariable pattern 31 and 32 together with variable data consisting of the value of the postage charge 33 for the item and the date 34 on which the impression is printed. The print data for selectively energising the thermal printing elements to print the invariable pattern 31 and 32 is stored in bit-map form in block 'A' of the memory 22. The print data for selectively energising the thermal printing elements to print the variable data is generated by the microprocessor. As illustrated by the flow chart of FIG. 4, upon starting a printing operation (step 40) the invariable print data is read out (step 41) and the print data generated by the microprocessor, corresponding to the variable data, is merged (step 42) with the data read (in step 41) from block 'A' of the memory 22 to energise selectively the thermal printing elements (step 43) to print a composite franking impression 31, 33, 32 and 34. During the printing operation the mail item is fed past the thermal printing elements in the direction of arrow 37, i.e. with the right hand edge of the mail item as shown in the drawing leading, so that the printing takes place progressively from right to left as shown in the drawing.

It may be desired to print a slogan or other primary message impression adjacent the franking impression. Print data for selectively energising the thermal printing elements 21 to print the primary message impression is stored in a second block, block 'B' of the memory 22. The user of the franking machine may, by an appropriate input on the keyboard 12, select a print operation in which the primary message impression is printed or a print operation in which no primary message impression is printed. The microprocessor 10 determines (step 44) whether or not the print operation includes printing of a primary message impression. If printing of a primary message impression has been selected (YES exit from 44) the primary message to be printed is selected (step 45) and, after reading out the print data from block 'A' of the memory to effect printing of the franking impression, the microprocessor reads out (step 46) primary message print data stored in block 'B' and utilises the primary message print data to selectively energise the thermal printing elements (step 47) to print the primary message impression immediately following printing of the franking impression so that the primary message impression is printed in a location 35 on the mail item immediately adjacent to the left side of the franking impression.

In addition to printing a franking impression and selectively printing a primary message impression, the program instructions of the microprocessor include steps whereby a secondary message impression may be printed. Information contained in the secondary message may relate to predefined selectable features, for example a numerical count incremented for each item franked, date or time at which the item is franked or class of mail, i.e. first class or second class. Alternatively the secondary message may contain text entered by the user on the keyboard 12 or from an external source via the input/output port 25. The text may be entered from the external source either as ascii characters or as print data in bit-map form. The secondary message is stored in a further block, block 'C' of the memory 22.

After read out of the primary message print data (step 46) from block 'B' of memory 22, the microprocessor 10 determines (step 48) whether the user has selected printing of a secondary message impression. If printing of a secondary message impression has been selected (YES exit of 47), the user selects the secondary message to be printed (step 49) and the microprocessor reads out (step 50) secondary message data from block 'C' of the memory 22 and utilises the secondary message data to selectively energise the thermal print elements at a time such as to print (step 51) the required secondary message impression in a location 36 situated to the left of the location 35 in which the primary message impression is printed. The printing operation then terminates (step 52). If a selection is made not to print the secondary message impression (NO exit of 47), the printing operation is terminated (step 53) after printing of the primary message impression.

Figure 3:
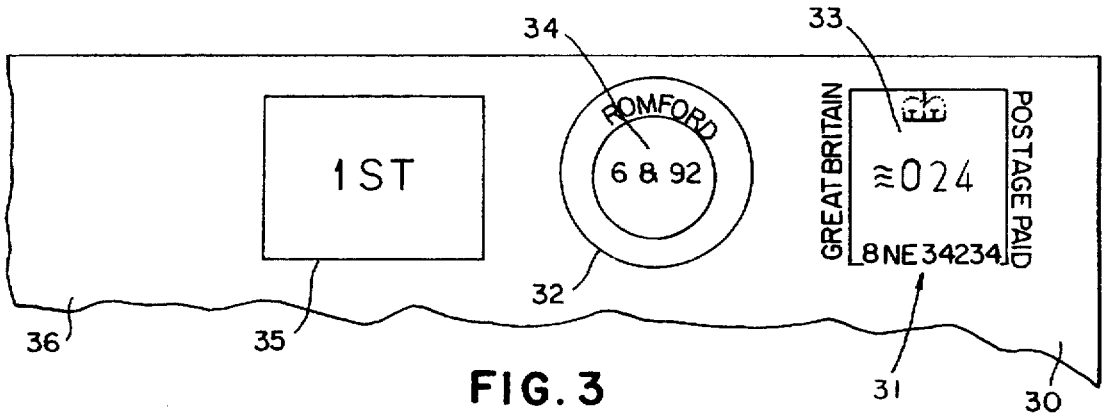
FIG. 3 is similar to FIG. 2 except that there is no primary message in the imprint.

The user may wish to select printing of the secondary message but to omit printing of the primary message. In the event of this option being selected it is preferred that, instead of leaving the location 35 empty, the secondary message is printed in the location 35 instead of being printed in the location 36 as shown in FIG. 3. Accordingly, when a selection is made (step 44) that the primary message impression is not to be printed (NO exit of 44), the microprocessor 10 determines (step 54) whether printing of the secondary message impression has been selected. If printing of the secondary message impression has been selected (YES exit of 54), the secondary message to be printed is selected (step 55) and the selected secondary message data is read out (step 56) from block 'C' of memory 22 and utilised by the microprocessor 10 to energise selectively the thermal printing elements in a time period such as to print (step 57) the secondary message impression at the location 35 on the mail item. The printing operation then terminates (step 58). If neither the primary message is selected to be printed nor the secondary message is selected to be printed (NO exit of 54) the printing operation terminates (step 59).

As described hereinbefore, the print data for the franking impression, the primary message impression and the secondary message impression is stored in defined blocks of the memory 22. When a printing operation is carried out, the software routine uses pointers to the memory for each impression to be printed. The pointer indicates the start address of the block of data for the impression. The block of data for the invariable part of the franking impression is determined by requirements of the postal authority for printing of a defined franking impression and cannot be varied by the user. However the blocks of data in blocks 'B' and 'C' corresponding to the primary and secondary messages may contain print data relating to more then one primary or secondary message and the user of the franking machine is enabled to select printing of a selected one of a group of primary messages (step 57) or to select that no primary message is printed and to select printing of a selected one of a group of secondary messages (step 58 or 59) or to select that no secondary message is printed. Accordingly the pointers used by the software routine in respect of block 'B' and 'C' of memory 22 indicate not only the block from which data is to be read but also areas within the blocks from which the data is to be read. The flow chart of FIG. 4 includes selection of primary message (step 45) and selection of secondary message (step 49 or step 55).

Usually the keyboard of a franking machine is provided with numerical keys and functions keys only. However if it is desired that the user be enabled to input text on the keyboard to form the secondary message, the text including alphabetic characters, the keyboard is arranged to permit input of both numeric and alphabetic characters. Information relating to selection of printing the primary and secondary messages preferably is displayed on the display 13 and where the user is enabled to select from a plurality of messages, it is preferred to display an indication of which message has been selected or, where the display is capable, to display the selected message in the form in which it will be printed.

It will be appreciated that the memory 22 needs to be non-volatile in order to retain the required print data during periods when the franking machine is not powered. If desired the memory 22 may be implemented as a part of one or both memory devices 15, 16.

The franking impression and in general the primary message impression include pictorial information, for example a pattern, and hence the print data for the invariable part of the franking impression and for the primary message is stored in bit-map form. If the secondary message imprint includes pictorial information the print data for the secondary message also is stored in bit-map form However it is envisaged that the secondary message impression may include only alpha-numeric characters and hence the secondary message data is generated and stored as ascii characters. Accordingly when printing of the secondary message is to be effected, the ascii characters are read out from the memory 22 and converted, by means of font look-up tables containing bit-map data for each character, into print data for controlling selection of the thermal printing elements. The print data is stored in buffer memory, for example in RAM 14, ready for output by the microprocessor to the print head.

If desired the franking machine may be arranged to permit selection of a printing operation in which printing of the franking impression is omitted and only the primary and secondary print impressions are printed or only the secondary print impression is printed.

I claim:

1. A franking machine including printing means; electronic control means; first memory means to store first data relating to a first impression to be printed in a first location on a mail item; second memory means to store second data relating to a second impression to be printed in a second location on the mail item; selection means operable to select printing of the first impression or omission of printing of said first impression; and said control means being operative in response to selection of printing said first impression to control the printing means to print the first impression in said first location on the mail item and to print the second impression in said second location on the mail item adjacent said first location and said control means being operative in response to selection of omission of printing the first impression to control the printing means to print the second impression in said first location.

2. A franking machine as claimed in claim 1 wherein the printing means is a digital printer including a plurality of selectively operable printing elements.

3. A franking machine as claimed in claim 2 wherein the mail item is fed past the printing elements in a feeding direction; said printing elements are disposed in a row extending transversely of said feeding direction; and the control means is operative to energise selectively said printing elements in a plurality of print cycles as the mail item is fed past the printing elements to form the first impression in the first location and the second impression in the second location or to form the second impression in the first location in a row by row manner on the mail item.

4. A franking machine as claimed in claim 3 wherein in response to selection of printing of the first impression the control means is operative initially to read out the first data from the first memory means and then to read out the second data from the second memory means and in response to selection of omission of printing of the first impression the control means is operative initially to read out the second data from the second memory means.

5. A franking machine as claimed in claim 1 wherein the electronic control means is operable under program steps of a software routine; wherein in response to selection of printing the first impression, the control means is operative to set a first pointer to the first data and a second pointer to the second data and wherein in response to selection of omission of printing of the first impression the control means is operative to set the first pointer to the second data.

6. A franking machine as claimed in claim 1 wherein the first data defines an invariable pattern of a franking impression and the first impression comprises a franking impression including a postage charge in respect of the mail item.

7. A franking machine as claimed in claim 1 including third memory means to store third data relating to a third print impression; and wherein the selection means is operable additionally to select printing of the second impression or omission of printing of the second impression; the control means being operative in response to selection of printing of the first and second impressions to control the printing means to print the third impression in a third location adjacent the second location and remote from the first location; and the control means being operative in response to selection of omission of printing of the second impression to control the printing means to print the third impression in the second location adjacent the first location.

8. A franking machine including printing means for printing on a mail item; electronic control means; first memory means associated with a first printing location on the mail item and operable to store first data defining a first impression to be printed in the first printing location on the mail item; second memory means associated with a second printing location on the mail item and operable to store second data defining a second impression to be printed in the second printing location on the mail item; selection means operable selectively to select printing of the first impression and the second impression and to select printing of said second impression and omission of printing of the first impression; and said control means being operative in response to selection of printing said first impression and said second impression to control the printing means to print the first impression in said first location on the mail item and to print the second impression in said second location on the mail item adjacent said first location and said control means being operative in response to selection of printing the second impression and omission of printing the first impression to control the printing means to print the second impression in said first location.

9. A franking machine including printing means for printing on a mail item; electronic control means; first memory means associated with a first printing location on the mail item and storing first data defining at least a part of a franking impression to be printed in the first printing location on the mail item; second memory means associated with a second printing location adjacent the first printing location on the mail item and storing second data defining a second impression to be printed in the second printing location on the mail item; third memory means associated with a third printing location adjacent the second location and remote from the first printing location on the mail item and storing third data defining a third impression to be printed in the third printing location on he mail item, selection means operable selectively (a) to select printing of the second impression and the third impression and (b) to select printing of said third impression and omission of printing of the second impression; and said control means being responsive to said selection means and being operative in an impression printing routine to read out the first, second and third memory means to control the printing means to print the first impression in said first location on the mail item, to print the second impression in said second location on the mail item and to print the third impression in said third location on the mail item in response to selection of printing the second and third impressions and to read out the first and third memory means to control the printing means to print the first impression in the first location and the third impression in said second location in response to selection of printing of said third impression and omission of printing the second impression.

* * * * *